US008905337B2

(12) United States Patent
Eriksson et al.

(10) Patent No.: US 8,905,337 B2
(45) Date of Patent: Dec. 9, 2014

(54) JAW CRUSHER

(75) Inventors: Bengt-Arne Eriksson, Svedala (SE); Roger Sjobeck, Malmo (SE); Karin Ljunggren, Limhamn (SE)

(73) Assignee: Sandvik Intellectual Property AB, Sandviken (SE)

( * ) Notice: Subject to any disclaimer, the term of this patent is extended or adjusted under 35 U.S.C. 154(b) by 0 days.

(21) Appl. No.: 14/342,564

(22) PCT Filed: Aug. 22, 2012

(86) PCT No.: PCT/EP2012/066347

§ 371 (c)(1), (2), (4) Date: Mar. 17, 2014

(87) PCT Pub. No.: WO2013/034441

PCT Pub. Date: Mar. 14, 2013

(65) Prior Publication Data

US 2014/0239101 A1 Aug. 28, 2014

(30) Foreign Application Priority Data

Sep. 5, 2011 (EP) ..... 11179994

(51) Int. Cl.
*B02C 1/02* (2006.01)
*B02C 1/10* (2006.01)

(52) U.S. Cl.
CPC .... *B02C 1/02* (2013.01); *B02C 1/10* (2013.01)
USPC ..... 241/30; 241/268

(58) Field of Classification Search
USPC ..... 241/30, 264–269
See application file for complete search history.

(56) References Cited

U.S. PATENT DOCUMENTS 3,473,744 A * 10/1969 Dediemar et al. ..... 241/219
4,637,562 A 1/1987 Hagiwara
2005/0082403 A1 4/2005 Boast

* cited by examiner

*Primary Examiner* — Mark Rosenbaum
(74) *Attorney, Agent, or Firm* — Corinne R. Gorski

(57) ABSTRACT

A jaw crusher includes s a toggle beam having a piston rod arrangement seat, a toggle plate, a first toggle plate seat arranged between the toggle plate and a movable jaw, a second toggle plate seat arranged between the toggle plate and the toggle beam, and a positioning device having a movable piston rod arrangement received by the piston rod arrangement seat of the toggle beam. The jaw crusher further has a toggle plate squeezing device including a contraction member. The squeezing device has a first mounting member connected to the movable jaw, and a second mounting member connected to the piston rod arrangement, to exert a pressing force on the first toggle plate seat, the second toggle plate seat and the piston rod arrangement seat.

10 Claims, 4 Drawing Sheets

JAW CRUSHER

RELATED APPLICATION DATA

This application is a §371 National Stage Application of PCT International Application No. PCT/EP2012/066447 filed Aug. 22, 2012 claiming priority of EP Application No. 11179994.6, filed Sep. 5, 2011.

TECHNICAL FIELD OF THE INVENTION

The present invention relates to a jaw crusher comprising a stationary jaw and a movable jaw forming between them a variable crushing gap, a toggle beam having a piston rod arrangement seat, a toggle plate arranged between the toggle beam and the movable jaw, a first toggle plate seat arranged between the toggle plate and the movable jaw, a second toggle plate seat arranged between the toggle plate and the toggle beam, and a positioning device having a movable piston rod arrangement, which is received by the piston rod arrangement seat of the toggle beam, for positioning the movable jaw.

BACKGROUND ART

Jaw crushers are utilized in many applications for crushing hard material, such as pieces of rock, ore, etc. A jaw crusher has a movable jaw that cooperates with a stationary jaw. Between the jaws a crushing gap is formed. The size of the crushing gap is often adjustable by means of a hydraulic ram which is connected to the movable jaw via a toggle plate and a toggle beam. Adjustment of the movable jaw position may be carried out to compensate for wear of wear parts and/or to adjust the size of the crushed material. In order to secure that the toggle plate is seated in a proper manner a jaw crusher may be provided with an arrangement that exerts a tensioning force acting to tension the toggle plate against toggle plate seats.

U.S. Pat. No. 4,637,562 discloses a jaw crusher with a toggle plate tensioning device where a compression spring exerts a force acting to tension the toggle plate against its respective toggle seats. U.S. Pat. No. 4,637,562 also discloses a hydraulic mechanism for adjusting the position of the movable jaw.

However, with the design described in U.S. Pat. No. 4,637,562 it may be difficult to secure a proper positioning of the toggle plate due to backlash arising during a crusher operation. Especially, upon presence of un-crushable material in the crusher such backlash may arise.

SUMMARY OF THE INVENTION

It is an object of the present invention to solve, or at least mitigate, parts or all of the above mentioned problems.

This object is achieved by means of a jaw crusher comprising a stationary jaw and a movable jaw forming between them a variable crushing gap, a toggle beam having a piston rod arrangement seat, a toggle plate arranged between the toggle beam and the movable jaw, a first toggle plate seat arranged between the toggle plate and the movable jaw, a second toggle plate seat arranged between the toggle plate and the toggle beam, and a positioning device having a movable piston rod arrangement, which is received by the piston rod arrangement seat of the toggle beam, for positioning the movable jaw, wherein the jaw crusher further comprises a toggle plate squeezing device comprising a contraction member, the squeezing device having a first mounting member which is connected to the movable jaw, and a second mounting member which is connected to the movable piston rod arrangement, to exert a pressing force on the first toggle plate seat, the second toggle plate seat and the piston rod arrangement seat.

An advantage of this jaw crusher is that the toggle beam may be freely and movably arranged to a piston rod arrangement of the positioning device allowing the toggle beam to twist independently upon presence of un-crushable material, sometimes referred to as "tramp material", in the crusher, and/or upon uneven feeding of material to an intake of the crusher. A further advantage of this jaw crusher is that a backlash free connection between the toggle beam and the positioning device for positioning the movable jaw may be achieved. This is possible since the squeezing device is connected to the hydraulic device in such a manner that the squeezing device always exerts a pressing force to each of the first toggle plate seat, the second toggle plate seat and the piston rod arrangement seat during a crusher operation and thus compensates for wear not only at the toggle plate seats but also at the piston rod arrangement seat. The pressing force exerted to each of the first toggle plate seat, the second toggle plate seat and the piston rod arrangement seat acts to avoid backlash and to hold the toggle plate in a proper position during a crusher operation. Hence, a backlash-free connection that fully squeezes the toggle plate against its seats and simultaneously squeezes the piston arrangement against its seat is provided. Even upon the relative movements arising due to the presence of un-crushable material in the crusher backlash will be avoided.

The toggle plate squeezing device is preferably at least partly turnable around an axis extending through the first and second mounting members in order to allow relative movements, e.g. upon presence of un-crushable material in the crusher, in several directions.

Preferably, at least one of the toggle beam and the piston rod seat comprises a curved joint surface to provide a robust and stable connection between the toggle beam and the piston rod arrangement and to allow relative movement between the toggle beam and the hydraulic positioning device in a smooth and safe manner.

The piston rod arrangement preferably comprises a piston rod head member having a curved joint surface facing the piston rod seat.

The second mounting member of the toggle plate squeezing device is preferably mounted turnable on the movable piston rod arrangement. This has the advantage that relative turning between the piston rod arrangement and the toggle plate squeezing device around an axis parallel to the piston rod is allowed.

Preferably, the second mounting member of the toggle plate squeezing device comprises a guide sleeve which is arranged around the piston rod of the piston rod arrangement to allow relative rotation between the piston rod arrangement and the toggle plate squeezing device around an axis parallel to the piston rod.

The piston rod head member preferably comprises a shoulder portion forming an abutment surface which is configured for abutment against the guide sleeve of the second mounting member. This has the advantage that a pressing force is exerted from the device to the seat via the piston rod arrangement in a very robust and stable manner.

The contraction member of the toggle plate squeezing device preferably comprises a compression spring and/or a hydraulic cylinder.

Furthermore, a method of squeezing a toggle plate of a jaw crusher comprising: a stationary jaw and a movable jaw forming between them a variable crushing gap, a toggle beam having a piston rod arrangement seat, a toggle plate arranged between the toggle beam and the movable jaw, a first toggle plate seat arranged between the toggle plate and the movable jaw, a second toggle plate seat arranged between the toggle plate and the toggle beam, and a hydraulic device having a movable piston rod arrangement, which is received by the piston rod arrangement seat of the toggle beam, for positioning the movable jaw is considered. The method involves applying a squeezing force between the movable jaw and the movable piston rod arrangement to exert a pressing force on the first toggle plate seat, the second toggle plate seat and the piston rod arrangement seat.

This method has the advantage that a toggle plate is held in position in a very robust and stable manner. Furthermore, backlash between the positioning device and the toggle beam will be avoided.

BRIEF DESCRIPTION OF THE DRAWINGS

The invention will hereafter be described in more detail and with reference to the appended drawings.

DETAILED DESCRIPTION OF PREFERRED EMBODIMENTS OF THE INVENTION

Figure 1:
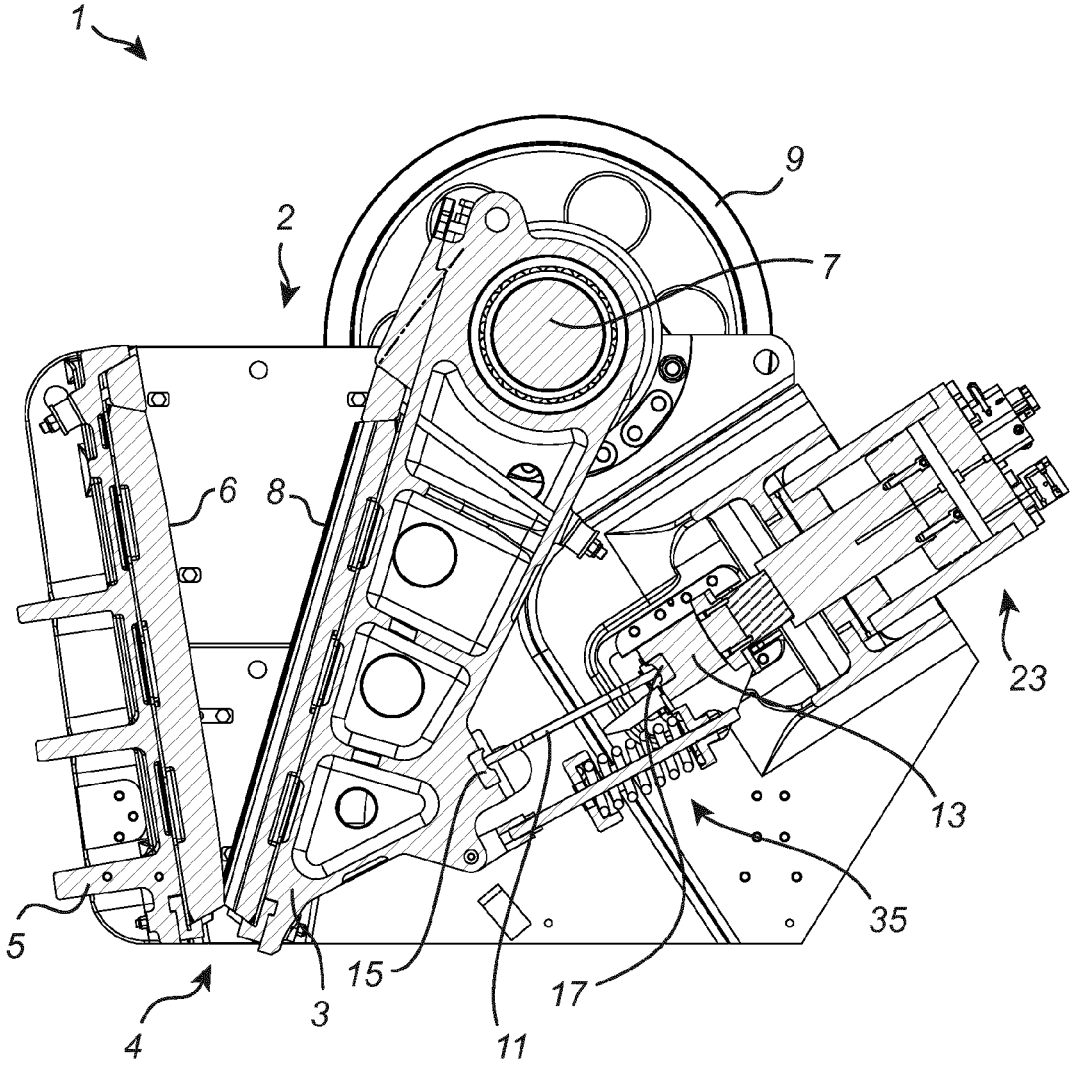
FIG. 1 is a cross-section and illustrates, schematically, a jaw crusher according to an embodiment of the present invention.

FIG. 1 is a cross-section and illustrates, schematically, a jaw crusher 1 according to an embodiment of the present invention. The jaw crusher 1 comprises a movable jaw 3 and a stationary jaw 5 forming between them a variable crushing gap. The movable jaw 3 is driven by an eccentric shaft 7 which causes the movable jaw 3 to move back and forth, up and down relative to the stationary jaw 5.

The inertia required to crush material fed to the crusher is provided by a weighted flywheel 9 operable to move the eccentric shaft 7 on which the movable jaw 3 is mounted. A motor (not shown) is operative for rotating the flywheel 9. The stationary jaw 5 is provided with a wear plate 6, and the movable jaw 3 is provided with a wear plate 8. The movement of the eccentric shaft 7 thus causes an eccentric motion of the movable jaw 3. Material to be crushed is fed to an intake 2 for material to be crushed. The crushed material leaves the crusher via an outlet 4 for material that has been crushed. The jaws 3, 5 are farther apart at the material intake 2 than at the material outlet 4, forming a tapered crushing chamber so that the material is crushed progressively to smaller and smaller sizes as the material travels downward towards the outlet 4 until the material is small enough to escape from the material outlet 4 at the bottom of the crushing chamber.

The crusher 1 comprises a toggle plate 11, a toggle beam 13, a first toggle plate seat 15 arranged at the lower end of the movable jaw 3 and a second toggle plate seat 17 arranged along a front edge of the toggle beam 13. The toggle plate 11 is seated between the first 15 and second 17 toggle plate seats.

The crusher 1 comprises a hydraulic positioning device 23 for positioning the movable jaw 3 to a desired position, i.e. to a desired closed side setting. By "closed side setting" is meant the shortest distance between the wear plate 6 of the stationary jaw 5 and the wear plate 8 of the movable jaw 3. For instance, the hydraulic positioning device 23 can be used to adjust the position of the movable jaw 3 to compensate for wear of the wear plates 6, 8 against which material is crushed. Furthermore, the hydraulic positioning device 23 may also be used for adjusting the position of the movable jaw 3 to adapt the jaw crusher 1 for crushing various types of materials, and to obtain various average sizes of the crushed material.

Figure 2:
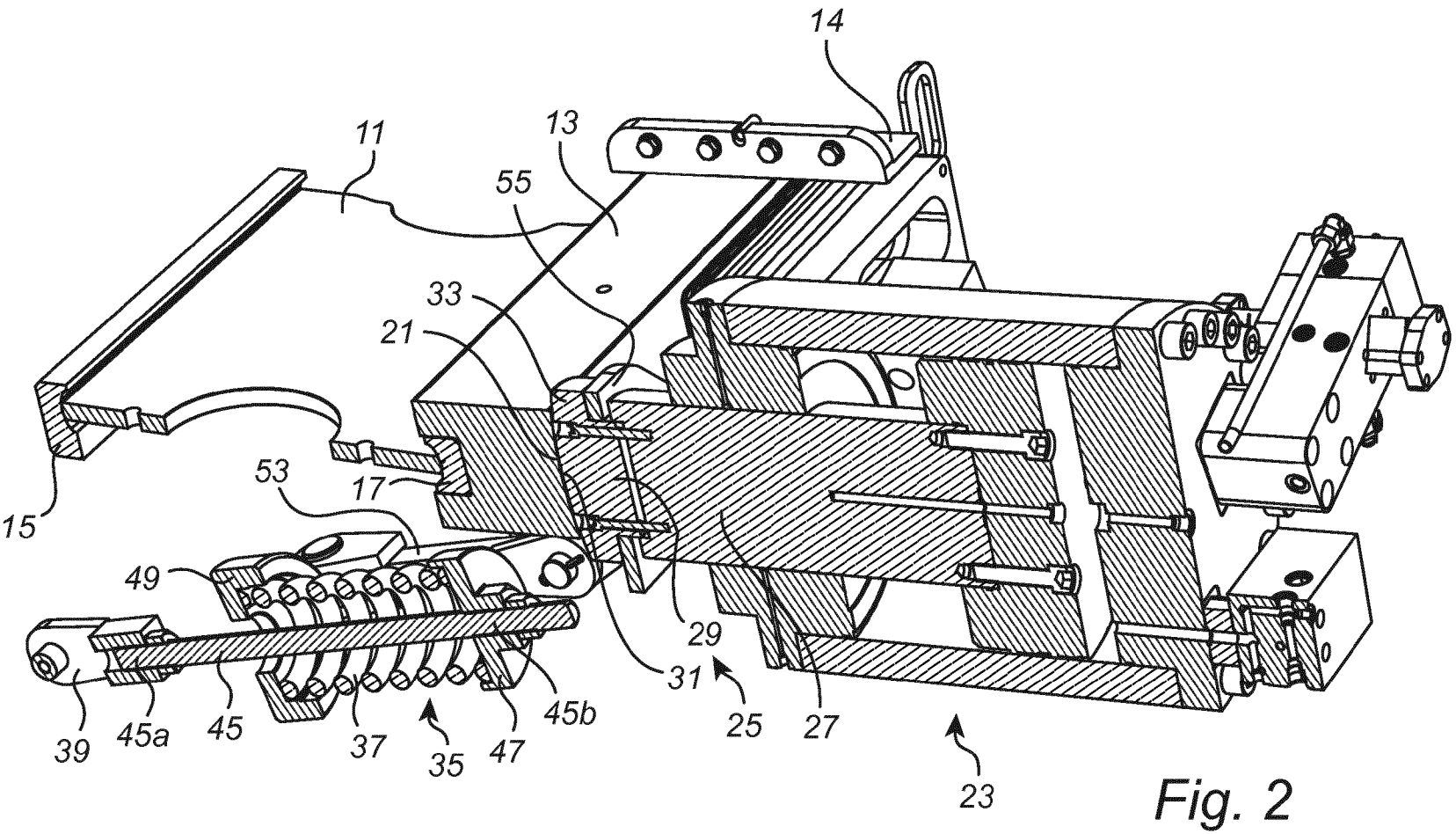
FIG. 2 is a cross-section and illustrates, schematically, parts of the jaw crusher shown in FIG. 1.
Figure 3:
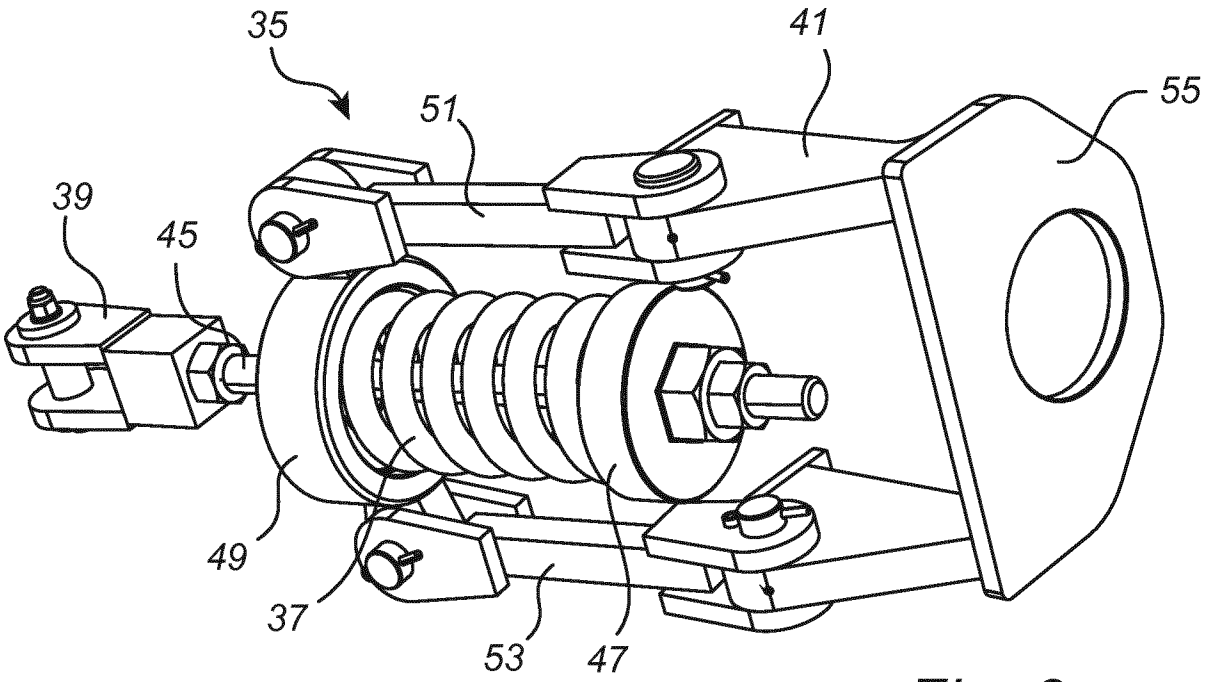
FIG. 3 is a perspective view and illustrates, schematically, a toggle plate squeezing device of the jaw crusher in FIG. 1.
Figure 4:
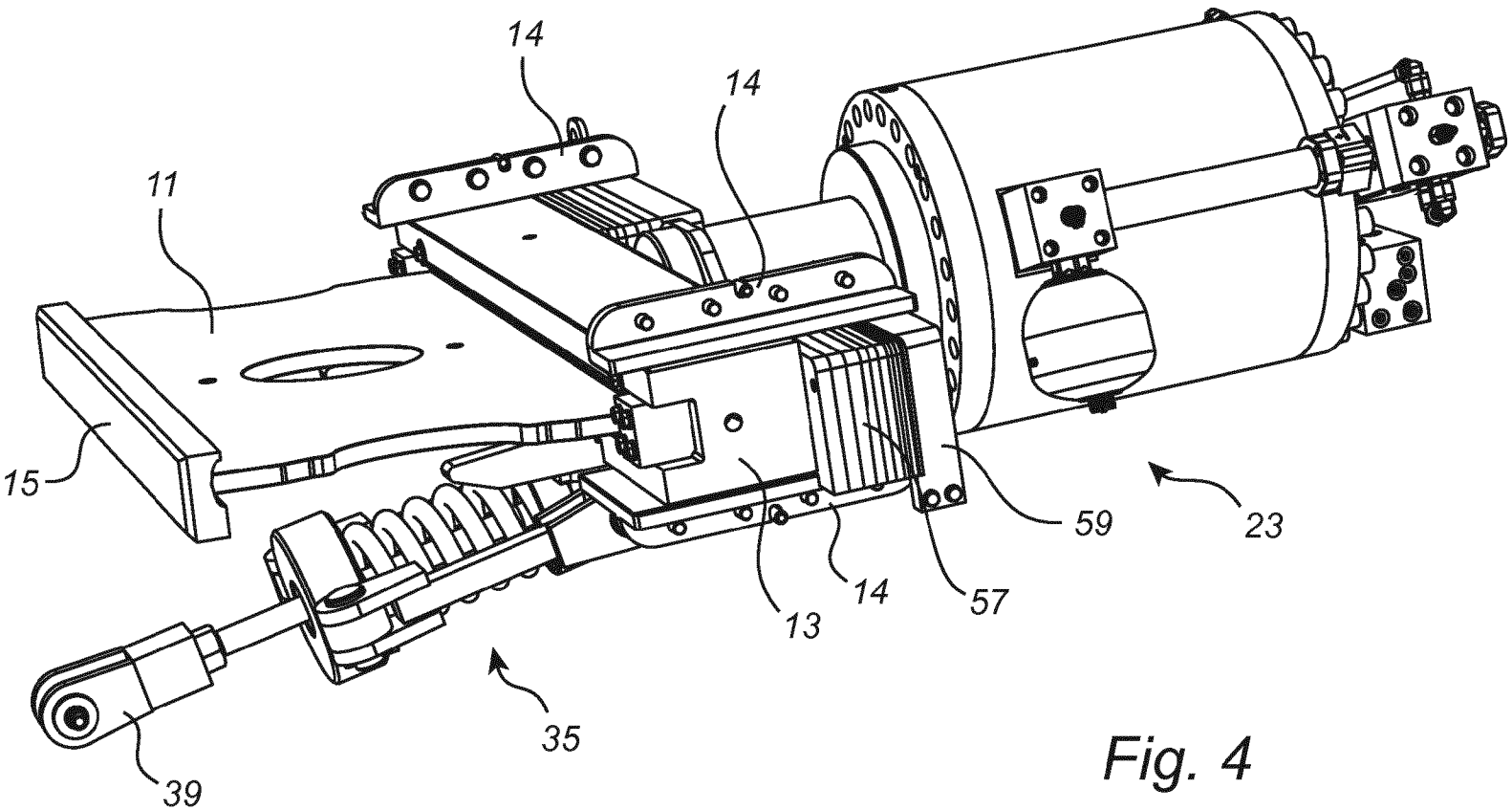
FIG. 4 is a perspective view and illustrates, schematically, parts of the jaw crusher shown in FIG. 1.

Referring to FIG. 2 and FIG. 3, which show parts of the crusher shown in FIG. 1, the jaw crusher 1 will hereinafter be further described. The toggle beam 13, which has a generally rectangular cross section, is slidably arranged along guide plates 14, of which one is visible in FIG. 2. Upper and lower guide plates 14, best illustrated in FIG. 4, are mounted in elongated apertures at respective side walls of the crusher 1. The toggle beam 13 and, hence, the movable jaw 3, are thus displaceable towards and away from the stationary jaw 5 under the guidance of the guide plates 14. Since the toggle beam 13 is slidable various closed side settings can be set, as will be described hereinafter.

Returning to FIG. 2, the hydraulic positioning device 23 comprises a double acting hydraulic cylinder having a piston rod arrangement 25. The piston rod arrangement 25 abuts the toggle beam 13. The piston rod arrangement 25 comprises a piston rod 27 and a piston rod head member 29 rigidly attached to the piston rod 27 such that the head member 29 moves with the piston rod 27. The piston rod head member 29 has a curved front portion 31 facing the toggle beam 13. The curved front portion 31 of the piston rod head member 29 is arranged to abut the back edge of the toggle beam 13. The toggle beam 13 thus comprises a curved piston arrangement seat 21, in the form of a toggle beam portion having a surface facing the piston rod arrangement 25. The curved front portion 31 of the piston rod head member 29 abuts the curved piston arrangement seat 21 as illustrated in FIG. 2. The piston rod head member 29 has a radially projecting shoulder portion 33 forming an abutment surface that abuts a guide sleeve of a toggle plate squeezing device 35, as will be described in more detail hereinafter.

The toggle plate squeezing device 35 comprises a contraction member, in the form of a compression spring 37, a first mounting member 39 which is connected to the movable jaw 3 and a second mounting member 41, best illustrated in FIG. 3, which is connected to the piston rod arrangement 25. The toggle plate squeezing device 35 is pivotally connected to a mounting bracket of the movable jaw 3 by the first mounting member 39. A rod 45 is at one end 45*a* connected to the first mounting member 39 and is at the other end 45*b* connected to a spring seat 47. The compression spring 37 is seated between the spring seat 47 and an annular collar 49 which is pivotally connected to a first 51 and second 53 linkage rods respectively. Each of the linkage rods 51, 53 is pivotally connected to the second mounting member 41 of the toggle plate squeezing device 35. The second mounting member 41 comprises a guide sleeve 55 which is movably arranged around the piston rod head member 29 of the piston rod arrangement 25 for abutment against the shoulder portion 33 of the piston rod head member 29. The toggle plate squeezing device 35 is at least partly turnable around the piston rod head member 29 to which the toggle plate squeezing device 35 is connected by the guide sleeve 55. The toggle plate squeezing device 35 is turnable around a geometrical axis extending through the piston rod 27. As best illustrated in FIG. 2, the guide sleeve 55 has a certain ability to move freely, and to be turned around an axis extending through the guide sleeve 55, by means of a gap formed between the shoulder portion 33 of the piston rod head member 29 and the piston rod 27.

The toggle plate squeezing device 35 is thus arranged to exert a pressing force, exerted by the compression spring 37, simultaneously acting on the first toggle plate seat 15, the second toggle plate seat 17 and the piston rod arrangement seat 21. Furthermore, the toggle plate squeezing device 35 has the ability to be turned around various axes, as an effect of, for example, un-crushable objects entering the crusher, or as an effect of uneven feeding of material over the intake 2, without losing its squeezing effect.

Initially, i.e. before running a crusher operation, the movable jaw 3 is normally adjusted using the hydraulic positioning device 23 until a desired closed side setting is reached. The size of the crushing gap may thus be adjusted by means of the hydraulic positioning device 23 which abuts the movable jaw 3 via the toggle plate 11 and the toggle beam 13.

During operation, the movable jaw 3 may be held in a desired position, i.e., in a desired closed side setting, either by means of the hydraulic positioning device 23, or by means of mechanical spacer elements. Typically, the hydraulic positioning device 23 would be utilized for holding the movable jaw 3 in position when the crushing forces are moderate, and/or when there is a substantial risk that un-crushable objects are fed to the jaw crusher 1 via the intake 2. The hydraulic positioning device 23 may be provided with a relief system relieving hydraulic pressure, and hence relieving crushing forces, when an un-crushable object is fed to the jaw crusher 1. On the other hand, when crushing occurs with high crushing forces and/or at a low risk of un-crushable objects being fed to the jaw crusher 1, then the jaw crusher 1 may be operated with mechanical spacer elements keeping the movable jaw 3 in position during crushing. Hence, the jaw crusher 1 may be operated in two different modes: either with the hydraulic positioning device 23 or with mechanical spacer elements keeping the movable jaw 3 in position.

When operating the jaw crusher 1 with mechanical spacer elements in order to set the movable jaw 3 in a desired position spacer elements, in the form of shims 57, may be arranged between the toggle beam 13 and a shim supporting element 59, as illustrated in FIG. 4. Shims of various widths may thus be used to set a desired closed side setting. The shims enable an operator to select a suitable combination of shims for a particular position of the toggle beam 13, and thereby the movable jaw 3, relative to the stationary jaw 5. The crusher 1 comprises a set of shims 57 comprising shims with various widths arranged between the toggle beam 13 and the supporting element 59. During operation in this mode crushing forces are transmitted from the movable jaw 3, via the toggle plate 11, the seats 15, 17, the toggle beam 13, and the set of shims 57, to the supporting element 59 and further to the support structures of the jaw crusher 1.

When operating the jaw crusher 1 with the hydraulic positioning device 23 holding the movable jaw 3 in position, the hydraulic positioning device 23 is kept pressurized during crusher operation, such that crushing forces are transmitted from the movable jaw 3, via the toggle plate 11, the seats 15, 17, the toggle beam 13, the curved piston arrangement seat 21, and the curved front portion 31, to the piston rod 27 and further to the support structures of the jaw crusher 1.

It will be appreciated that numerous modifications of the embodiments described above are possible within the scope of the appended claims.

Hereinbefore, it has been described that the contraction member 37 comprises a compression spring 37, as illustrated in FIGS. 2 and 3. It will be appreciated that other types of contraction members 37 could also be utilized. Examples of other types of contraction members 37 include hydraulic cylinders, and combinations of hydraulic cylinders and springs.

Hereinbefore it has been described that the positioning device 23 is a hydraulic positioning device 23 for hydraulically controlling the position of the movable jaw 3. It will be appreciated that other types of the positioning devices could also be utilized. Examples of such other types of the positioning devices include spring-loaded positioning devices, positioning devices involving threaded bars, and motor controlled positioning devices.

Hereinbefore it has been illustrated that the first and second mounting members 39, 41 of the squeezing device 35 are connected to the movable jaw 3, and the piston rod arrangement 25, respectively. It will be appreciated that such connections could include various linkages, rods, etc., connecting the respective mounting member 39, 41 to the respective jaw 3 and piston rod arrangement 25.

The invention claimed is:

1. A jaw crusher comprising:

a stationary jaw and a movable jaw forming between them a variable crushing gap;

a toggle beam having a piston rod arrangement seat;

a toggle plate arranged between the toggle beam and the movable jaw;

a first toggle plate seat arranged between the toggle plate and the movable jaw;

a second toggle plate seat arranged between the toggle plate and the toggle beam;

a positioning device having a movable piston rod arrangement received by the piston rod arrangement seat of the toggle beam, for positioning the movable jaw; and a toggle plate squeezing device including a contraction member, the squeezing device having a first mounting member connected to the movable jaw, and a second mounting member is connected to the movable piston rod arrangement, to exert a pressing force on the first toggle plate seat, the second toggle plate seat and the piston rod arrangement seat.

2. A jaw crusher according to claim 1, wherein the toggle plate squeezing device is at least partly turnable around an axis extending through the first mounting member.

3. A jaw crusher according to claim 1, wherein the toggle plate squeezing device is at least partly turnable around an axis extending through the second mounting member.

4. A jaw crusher according to claim 1, wherein at least one of the toggle beam and the piston rod arrangement seat includes a curved joint surface.

5. A jaw crusher according to claim 1, wherein the movable piston rod arrangement includes a piston rod head member having a curved joint surface facing the piston rod arrangement seat.

6. A jaw crusher according to claim 1, wherein the second mounting member of the toggle plate squeezing device is turnably mounted on the piston rod arrangement.

7. A jaw crusher according to claim 1, wherein the second mounting member of the toggle plate squeezing device comprises a guide sleeve arranged around a piston rod of the piston rod arrangement.

8. A jaw crusher according to claim 7, wherein the piston rod head member includes a shoulder portion configured for abutment against the guide sleeve.

9. A jaw crusher according to claim 1, wherein the contraction member of the toggle plate squeezing device includes a compression spring and/or a hydraulic cylinder.

10. A method of squeezing a toggle plate of a jaw crusher, the jaw crusher including a stationary jaw and a movable jaw forming between them a variable crushing gap, a toggle beam having a piston rod arrangement seat, a toggle plate arranged between the toggle beam and the movable jaw, a first toggle plate seat arranged between the toggle plate and the movable jaw, a second toggle plate seat arranged between the toggle plate and the toggle beam, and a positioning device having a movable piston rod arrangement received by the piston rod arrangement seat of the toggle beam, for positioning the movable jaw, the method comprising the steps of applying a squeezing force between the movable jaw and the movable piston rod arrangement to exert a pressing force on the first toggle plate seat, the second toggle plate seat and the piston rod arrangement seat.

* * * * *